US011965350B1

(12) United States Patent
Shukovitsky

(10) Patent No.: US 11,965,350 B1
(45) Date of Patent: Apr. 23, 2024

(54) CANOPY MOUNTING AND SUPPORT SYSTEM

(71) Applicant: Daniel Shukovitsky, Smithville (CA)

(72) Inventor: Daniel Shukovitsky, Smithville (CA)

( * ) Notice: Subject to any disclaimer, the term of this patent is extended or adjusted under 35 U.S.C. 154(b) by 158 days.

(21) Appl. No.: 17/718,380

(22) Filed: Apr. 12, 2022

(51) Int. Cl.
*E04H 15/04* (2006.01)

(52) U.S. Cl.
CPC ..... *E04H 15/04* (2013.01)

(58) Field of Classification Search
CPC ..... E04H 15/02; E04H 15/32; E04H 15/58
See application file for complete search history.

(56) References Cited

U.S. PATENT DOCUMENTS 961,704 A * 6/1910 Mark ..... A45F 3/22 5/121
3,060,949 A * 10/1962 Moss ..... E04H 15/58 D25/56
4,008,730 A * 2/1977 Keklak ..... E04H 15/04 52/63
4,071,917 A * 2/1978 Mojica ..... E04H 15/04 135/96
4,308,883 A * 1/1982 Malone ..... E04H 15/32 135/90
5,263,675 A 11/1993 Roberts
5,622,197 A * 4/1997 Valaire ..... E04H 15/58 114/106
6,353,946 B1 * 3/2002 Steiner ..... E04H 15/04 5/120
6,588,440 B2 * 7/2003 Varnado ..... E04H 15/04 248/230.8
7,182,091 B2 * 2/2007 Maddox ..... A01M 31/025 182/135
7,191,732 B2 3/2007 Neal, Jr.
7,544,120 B1 6/2009 Tardif
D628,872 S 12/2010 Stanley
7,958,968 B1 * 6/2011 Stabler ..... E04H 15/04 135/901
10,301,840 B1 * 5/2019 Jin ..... F16H 31/001
10,731,694 B2 * 8/2020 Pena ..... E04H 15/58
11,008,772 B2 * 5/2021 Tillotson ..... A45F 3/52
2003/0178255 A1 9/2003 Auer
2005/0177938 A1 * 8/2005 Steiner ..... E04H 15/04 5/120
2005/0188460 A1 * 9/2005 O'Brien ..... A45F 3/52 5/120
2007/0138359 A1 6/2007 Johnson
2010/0269874 A1 * 10/2010 Jacoby ..... E04H 15/04 135/90
2020/0157836 A1 * 5/2020 Graham ..... A45F 3/24

FOREIGN PATENT DOCUMENTS

WO 2019165276 8/2019

* cited by examiner

*Primary Examiner* — Noah Chandler Hawk
(74) *Attorney, Agent, or Firm* — Kyle A. Fletcher, Esq.

(57) ABSTRACT

The canopy mounting and support system is a temporary shelter. The canopy mounting and support system includes a plurality of support structures, a tarpaulin, and a plurality of vertically oriented anchor structures. The plurality of support structures secures the tarpaulin to the plurality of vertically oriented anchor structures. The plurality of support structures elevates the tarpaulin above a protected space formed by the canopy mounting and support system.

12 Claims, 4 Drawing Sheets

CANOPY MOUNTING AND SUPPORT SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of tents and canopies. (E04H15/00)

SUMMARY OF INVENTION

The canopy mounting and support system is a temporary shelter. The canopy mounting and support system comprises a plurality of support structures, a tarpaulin, and a plurality of vertically oriented anchor structures. The plurality of support structures secures the tarpaulin to the plurality of vertically oriented anchor structures. The plurality of support structures elevates the tarpaulin above a protected space formed by the canopy mounting and support system.

These together with additional objects, features and advantages of the canopy mounting and support system will be readily apparent to those of ordinary skill in the art upon reading the following detailed description of the presently preferred, but nonetheless illustrative, embodiments when taken in conjunction with the accompanying drawings.

In this respect, before explaining the current embodiments of the canopy mounting and support system in detail, it is to be understood that the canopy mounting and support system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the canopy mounting and support system.

It is therefore important that the claims be regarded as including such equivalent construction insofar as they do not depart from the spirit and scope of the canopy mounting and support system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
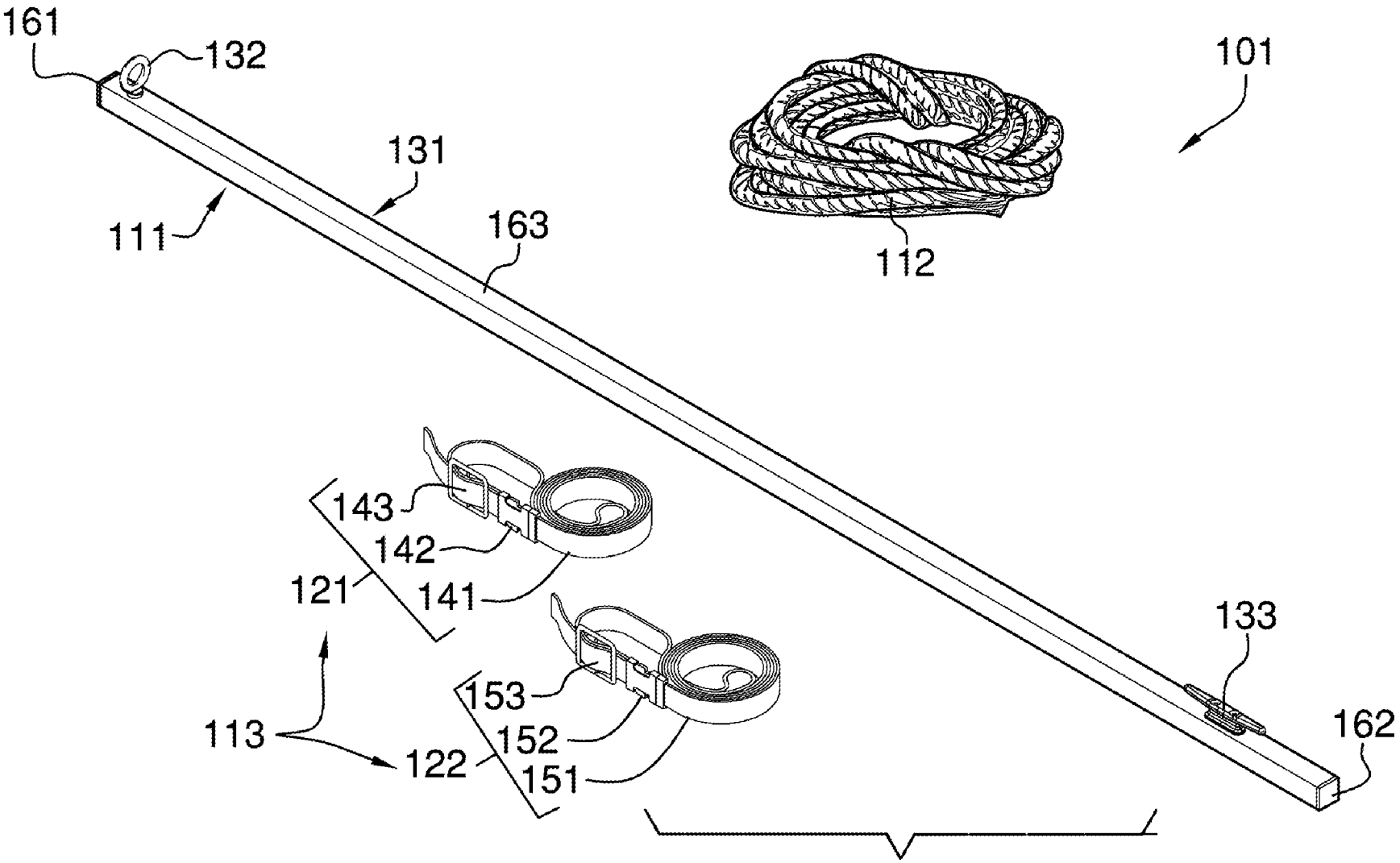
FIG. 1 is a perspective view of an embodiment of the disclosure.
Figure 2:
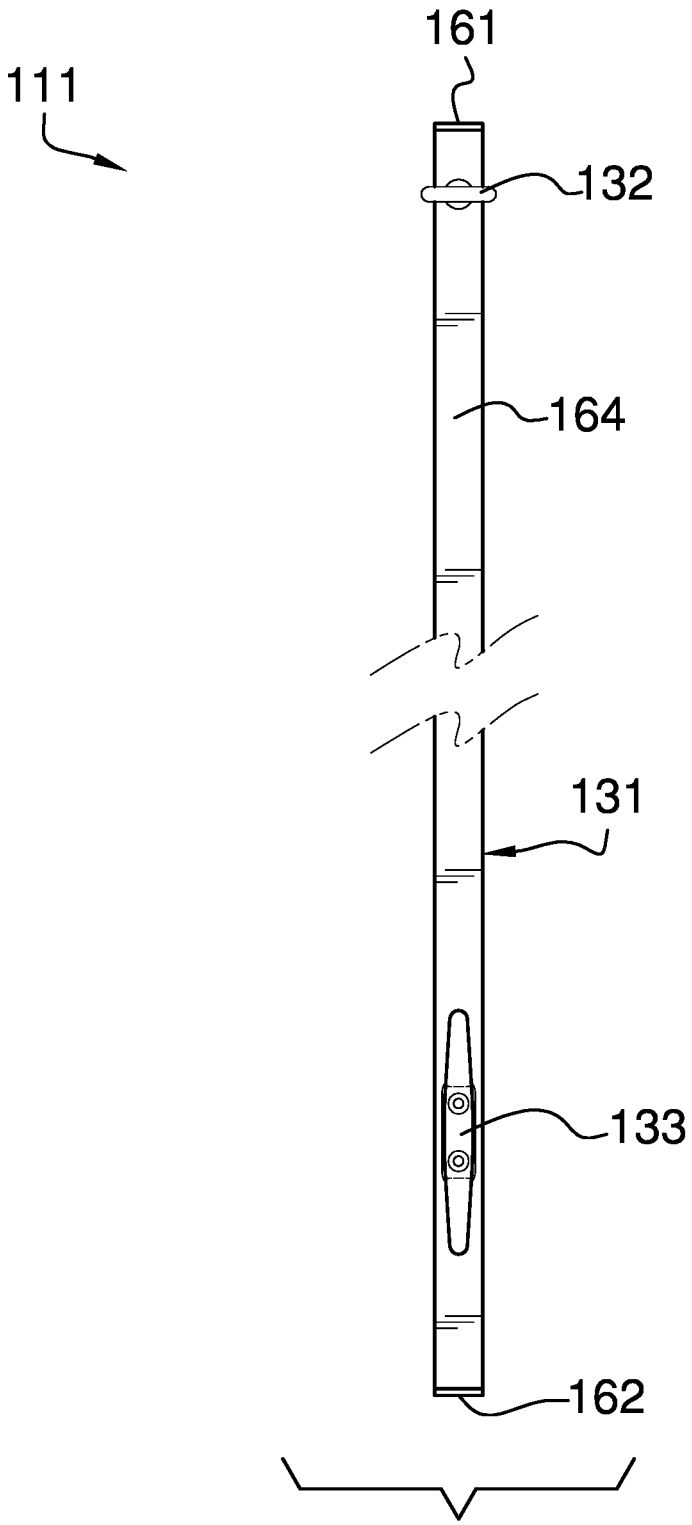
FIG. 2 is a front view of an embodiment of the disclosure.
Figure 3:
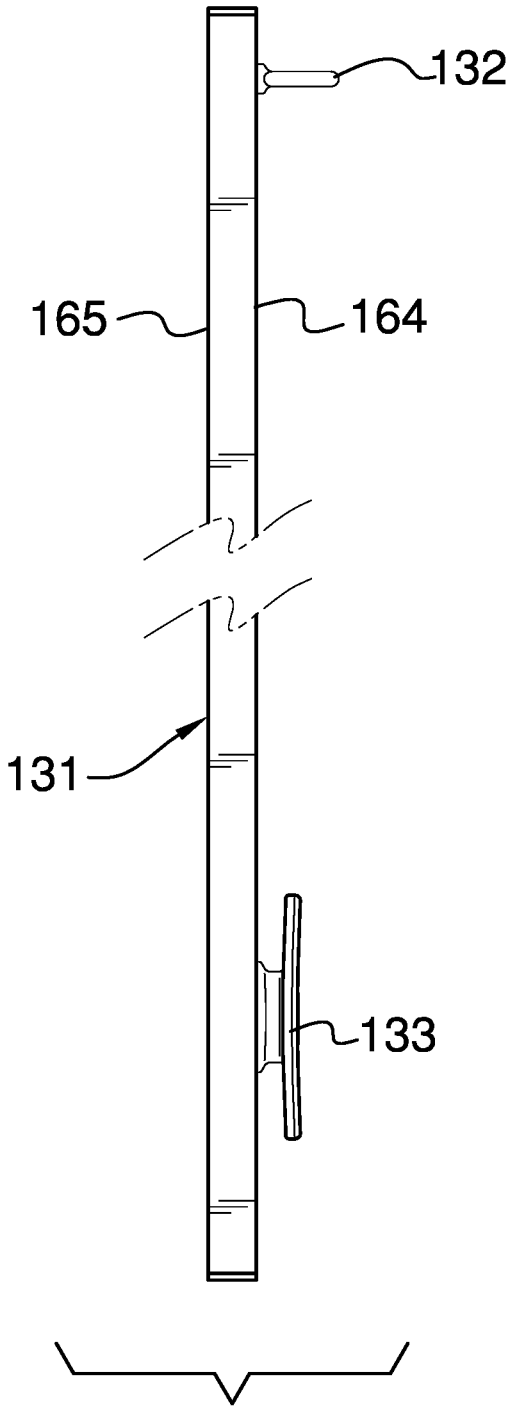
FIG. 3 is a side view of an embodiment of the disclosure.
Figure 4:
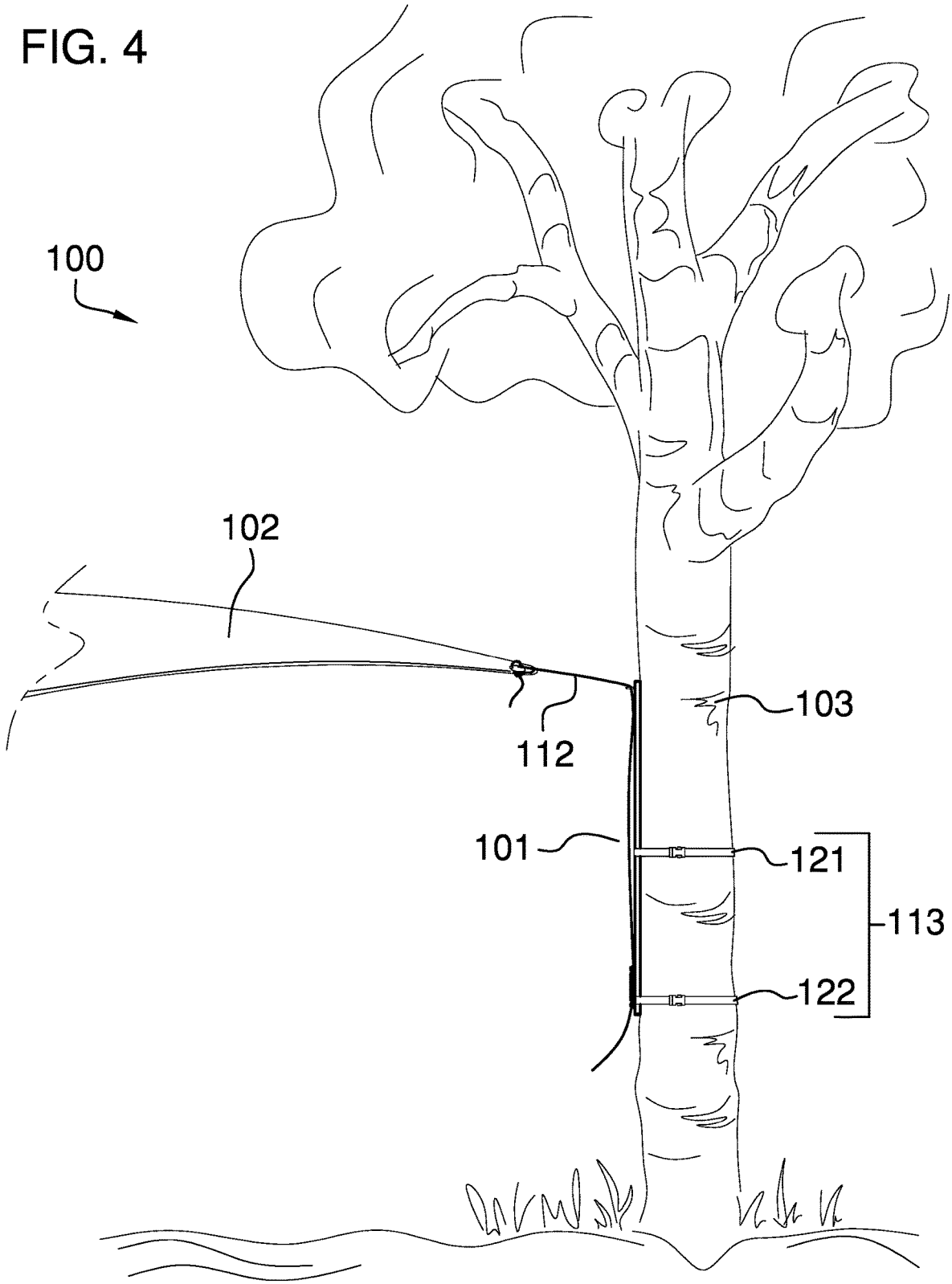
FIG. 4 is an in-use view of an embodiment of the disclosure.

Detailed reference will now be made to one or more potential embodiments of the disclosure, which are illustrated in FIGS. 1 through 4.

The canopy mounting and support system 100 (hereinafter invention) is a temporary shelter. The invention 100 comprises a plurality of support structures 101, a tarpaulin 102, and a plurality of vertically oriented anchor structures 103. The plurality of support structures 101 secures the tarpaulin 102 to the plurality of vertically oriented anchor structures 103. The plurality of support structures 101 elevates the tarpaulin 102 above a protected space formed by the invention 100.

The tarpaulin 102 is a sheeting structure. Each individual support structure 111 selected from the plurality of support structures 101 attaches the tarpaulin 102 to a vertically oriented anchor structure selected from the plurality of vertically oriented anchor structures 103. The plurality of vertically oriented anchor structures 103 and the plurality of support structures 101 elevate the tarpaulin 102 above a supporting surface. The elevated tarpaulin 102 forms a horizontally oriented barrier that forms the superior surface of the protected space formed by the invention 100.

Each vertically oriented anchor structure selected from the plurality of vertically oriented anchor structures 103 forms a vertically oriented anchor point. Each individual support structure 111 selected from the plurality of support structures 101 is bound to a vertically oriented anchor structure selected from the plurality of vertically oriented anchor structures 103. Each selected individual support structure 111 binds the tarpaulin 102 to the selected vertically oriented anchor structure. Each selected vertically oriented anchor structure is selected from the group consisting of a naturally occurring structure and a manufactured structure.

The plurality of support structures 101 comprises a plurality of individual support structures 111. Each individual support structure 111 selected from the plurality of support structures 101 is a mechanical structure. Each selected individual support structure 111 attaches to a vertically oriented anchor structure selected from the plurality of vertically oriented anchor structures 103. Each selected individual support structure 111 attaches to the selected vertically oriented anchor structure such that the center axis of the selected individual support structure 111 is vertically oriented. Each selected individual support structure 111 attaches to the selected vertically oriented anchor structure. Each selected individual support structure 111 attaches to the selected vertically oriented anchor structure with a tight fit. Each selected individual support structure 111 attaches the tarpaulin 102 to the selected vertically oriented anchor structure. Each individual support structure 111 is identical. Each individual support structure 111 comprises a cord 112, a plurality of cinch straps 113, a base structure 131, an eyebolt structure 132, and a cleat 133.

The base structure 131 is a rigid structure. The eyebolt structure 132 and the cleat 133 attach to the base structure 131. The plurality of cinch straps 113 bind the base structure 131 to the vertically oriented anchor structure selected from the plurality of vertically oriented anchor structures 103.

The base structure 131 comprises a plurality of superior congruent end 161, an inferior congruent end 162, and a plurality of lateral faces 163.

The superior congruent end 161 is a congruent end of the base structure 131. The superior congruent end 161 forms the superior structure of the invention 100. The inferior congruent end 162 is a congruent end of the base structure 131. The inferior congruent end 162 forms the congruent end of the base structure 131 that is distal from the superior congruent end 161.

The plurality of lateral faces 163 forms the lateral face structure of the base structure 131. The plurality of lateral faces 163 further comprises an exterior lateral face 164 and an interior lateral face 165. The interior lateral face 165 is the lateral face selected from the plurality of lateral faces 163 of the base structure 131 that is placed against the selected vertically oriented anchor structure to form the lateral structure between the base structure 131 and the selected vertically oriented anchor structure. The exterior lateral face 164 is the lateral face selected from the plurality of lateral faces 163 that is distal from the interior lateral face 165.

The eyebolt structure 132 is an eyebolt. The eyebolt structure 132 attaches to the exterior lateral face 164 of the base structure 131. The eyebolt structure 132 is located at a position that is superior to the cleat 133. The eyebolt structure 132 is located at a position proximal to the superior congruent end 161 of the base structure 131. The cord 112 is threaded through the eyebolt structure 132 such that the center axis of the cord 112 is vertically redirected towards the cleat 133.

The cleat 133 is a mechanical structure. The cleat 133 attaches to the exterior lateral face 164 of the base structure 131. The cleat 133 is located at a position that is inferior to the eyebolt structure 132. The cleat 133 is located at a position proximal to the inferior congruent end 162 of the base structure 131. The cleat 133 secures the plurality of cinch straps 113 to the base structure 131. The cord 112 ties onto the cleat 133 such that the cord 112 runs through the eyebolt structure 132 to attach to the tarpaulin 102.

The cord 112 attaches the tarpaulin 102 to an individual support structures 111. The cord 112 is a flexible structure. The cord 112 is formed with a tensile strength but does not have any significant compressive strength. The cord 112 is defined elsewhere in this disclosure.

Each cinch strap selected from the plurality of cinch straps 113 is a fastening structure. Each selected cinch strap binds the individual support structure 111 to the vertically oriented anchor structure selected from the plurality of vertically oriented anchor structures 103 that is associated with the individual support structure 111. Each selected cinch strap binds the individual support structure 111 to the selected vertically oriented anchor structure with a tight fit. The plurality of cinch straps 113 comprises a plurality of superior cinch strap 121 and an inferior cinch strap 122.

The superior cinch strap 121 is a first cinch strap selected from the plurality of cinch straps 113. The superior cinch strap 121 binds the individual support structure 111 to its associated selected vertically oriented anchor structure. The superior cinch strap 121 further comprises a superior webbing 141, a superior quick release buckle 142, and a superior ring and slider arrangement 143.

The superior webbing 141 is a textile based webbing structure. The superior webbing 141 is a flexible structure. The superior webbing 141 forms the physical structure that binds the base structure 131 of the individual support structure 111 to the selected vertically oriented anchor structure. The superior quick release buckle 142 is a fastening structure. The superior quick release buckle 142 attaches the superior webbing 141 to itself to form a loop structure that wraps around the selected vertically oriented anchor structure. The quick release buckle is defined elsewhere in this disclosure. The superior ring and slider arrangement 143 is a mechanical structure. The superior webbing 141 threads through the superior ring and slider arrangement 143. The superior ring and slider arrangement 143 adjusts the span of the length of the superior webbing 141 that is presented to the selected vertically oriented anchor structure by the superior cinch strap 121. The superior ring and slider arrangement 143 adjusts the span of the length of the superior webbing 141 such that the superior cinch strap 121 binds to the selected vertically oriented anchor structure with a tight fit.

The inferior cinch strap 122 is a second cinch strap selected from the plurality of cinch straps 113. The inferior cinch strap 122 binds the individual support structure 111 to its associated selected vertically oriented anchor structure. The inferior cinch strap 122 is located at a position that is inferior to the superior cinch strap 121. The inferior cinch strap 122 further comprises an inferior webbing 151, an inferior quick release buckle 152, and an inferior ring and slider arrangement 153.

The inferior webbing 151 is a textile based webbing structure. The inferior webbing 151 is a flexible structure. The inferior webbing 151 forms the physical structure that binds the base structure 131 of the individual support structure 111 to the selected vertically oriented anchor structure. The inferior quick release buckle 152 is a fastening structure. The inferior quick release buckle 152 attaches the inferior webbing 151 to itself to form a loop structure that wraps around the selected vertically oriented anchor structure. The quick release buckle is defined elsewhere in this disclosure. The inferior ring and slider arrangement 153 is a mechanical structure. The inferior webbing 151 threads through the inferior ring and slider arrangement 153. The inferior ring and slider arrangement 153 adjusts the span of the length of the inferior webbing 151 that is presented to the selected vertically oriented anchor structure by the inferior cinch strap 122. The inferior ring and slider arrangement 153 adjusts the span of the length of the inferior webbing 151 such that the inferior cinch strap 122 binds to the selected vertically oriented anchor structure with a tight fit.

DEFINITIONS AND DIRECTIONAL REFERENCES

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Barrier: As used in this disclosure, a barrier is a physical obstacle that forms a boundary between a first space and a second space. The barrier prevents the passage of an object between the first space and the second space.

Bind: As used in this disclosure, to bind is a verb that means to tie or secure a first object to a second object using a strap, cord, or webbing. Bind can also mean to tie or secure a plurality of similar first objects together by wrapping a second object around the plurality of similar first objects.

Buckle: As used in this disclosure, a buckle is a fastening device that is used for joining a first free end of a strap to a second free end of the same strap or a different strap. A buckle further comprises a first (also called the male) connector that is attached to the first free end and a second (also called the female) connector that is attached to the second free end. The male connector has a pin or other structure that is generally caught by a structure formed in the female connector.

Canopy: As used in this disclosure, a canopy is a sheeting structure, usually made of fabric, that is placed above an area and creates a protected space within which people or objects are protected from the environment.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder. The center axis is the line that joins the center point of the first congruent face to the center point of the second corresponding congruent face. The center axis of a pyramid refers to a line formed through the apex of the pyramid that is perpendicular to the base of the pyramid. When the center axes of two cylinder, or pyramidal structures share the same line they are said to be aligned. When the center axes of two cylinder, or pyramidal structures do not share the same line they are said to be offset.

Cleat: As used in this disclosure, a cleat is an object around which a rope, cord, or wire can be secured.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord. This definition further includes textile webbings as a type of cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is an object that is flat in appearance. The disk is formed from two congruent ends that are attached by a lateral face.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Eyebolt: As used in this disclosure, an eyebolt is a bolt or screw that is formed with a ring at one end.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow shaped containment structure. The pan has a single open face. The open face of the pan is often, but not always, the superior face of the pan. The open face is a surface selected from the group consisting of: a) a congruent end that forms the pan; and, b) a lateral face that forms the pan. A semi-enclosed pan refers to a pan wherein the closed end of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces.

Protected Space: As used in this disclosure, a protected space is a negative space within which an object is stored. The protected space is enclosed by a barrier structure that: a) prevents damage to the object contained within the protected space; b) maintains an environment suitable within the protected space that is appropriate for the object; or, c) protects the object within the protected space from potential dangers that are outside of the protected space.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Ring and Slider Arrangement: As used in this disclosure, a ring and slider arrangement is an apparatus comprising a ring component and a slider component that is used to adjust the effective length of a webbing in an application. In the ring and slider arrangement, an end of the webbing is inserted through the slider component, looped through the ring component and then reverse threaded through the slider component for a second time. By adjusting the position of the slider component relative to the webbing, the effective length of the webbing can be adjusted. Ring and slider arrangements are well known and documented in the textile arts.

Roughly: As used in this disclosure, roughly refers to a comparison between two objects. Roughly means that the difference between one or more parameters of the two compared objects are not significantly different.

Strap: As used in this disclosure a strap is a strip of leather, cloth, or other flexible material, often with a buckle, that is used to fasten, secure, carry, or hold onto something.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tarpaulin: As used in this disclosure, a tarpaulin is a protective covering made of a sheeting. The sheeting can be a textile material made from made from fibers or yarns suitable for textile production methods including, but not limited to, weaving, knitting, or felting. The sheeting can also be made of material in the form of a continuous film including, but not limited to, plastic films and metal foils.

Textile: As used in this disclosure, a textile is a material that is woven, knitted, braided, or felted. Synonyms in common usage for this definition include fabric and cloth. The two surfaces of the textile with the greatest surface area are called the faces of the textile.

Tight Fit: As used in this disclosure, a tight fit refers to the attachment of a first object into a second object such that there is not a lot of space between the first object and the second object. By not a lot of space is meant that friction occurs when the first object moves within the second object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A canopy mounting and support system comprising
- a plurality of support structures, a tarpaulin, and a plurality of vertically oriented anchor structures;
- wherein the plurality of support structures secures the tarpaulin to the plurality of vertically oriented anchor structures;
- wherein the plurality of support structures comprises a plurality of individual support structures;
- wherein each individual support structure comprises a cord, a plurality of cinch straps, a base structure, an eyebolt structure, and a cleat;
- wherein the cord attaches the tarpaulin to the individual support structure;
- wherein the plurality of cinch straps binds the base structure to the vertically oriented anchor structure selected from the plurality of vertically oriented anchor structures;
- wherein the cleat and the eyebolt structure attach to the base structure.

2. The canopy mounting and support system according to claim 1
- wherein the canopy mounting and support system is a temporary shelter;
- wherein the plurality of support structures elevates the tarpaulin above a protected space formed by the canopy mounting and support system;
- wherein the tarpaulin is a sheeting structure;
- wherein each vertically oriented anchor structure selected from the plurality of vertically oriented anchor structures forms a vertically oriented anchor point.

3. The canopy mounting and support system according to claim 2
- wherein each individual support structure selected from the plurality of support structures is bound to a vertically oriented anchor structure selected from the plurality of vertically oriented anchor structures;
- wherein each selected individual support structure binds the tarpaulin to the selected vertically oriented anchor structure.

4. The canopy mounting and support system according to claim 3
- wherein each individual support structure selected from the plurality of support structures is a mechanical structure;
- wherein each selected individual support structure attaches to a vertically oriented anchor structure selected from the plurality of vertically oriented anchor structures;
- wherein each selected individual support structure attaches to the selected vertically oriented anchor structure such that the center axis of the selected individual support structure is vertically oriented;
- wherein each selected individual support structure attaches to the selected vertically oriented anchor structure to form a lateral structure;
- wherein each selected individual support structure attaches to the selected vertically oriented anchor structure with a tight fit;
- wherein each selected individual support structure attaches the tarpaulin to the selected vertically oriented anchor structure;
- wherein each individual support structure is identical.

5. The canopy mounting and support system according to claim 4
- wherein the base structure is a rigid structure;
- wherein the base structure of each individual support structure comprises a superior congruent end, an inferior congruent end, and a plurality of lateral faces;
- wherein the superior congruent end is a congruent end of the base structure;
- wherein the superior congruent end forms the superior structure of the canopy mounting and support system;
- wherein the inferior congruent end is a congruent end of the base structure;
- wherein the inferior congruent end forms the congruent end of the base structure that is distal from the superior congruent end;
- wherein the plurality of lateral faces forms the lateral face structure of the base structure;
- wherein the plurality of lateral faces further comprises an exterior lateral face and an interior lateral face;
- wherein the interior lateral face is the lateral face selected from the plurality of lateral faces of the base structure that is placed against the selected vertically oriented anchor structure to form the lateral structure between the base structure and the selected vertically oriented anchor structure;
- wherein the exterior lateral face is the lateral face selected from the plurality of lateral faces that is distal from the interior lateral face.

6. The canopy mounting and support system according to claim 5
- wherein the eyebolt structure is an eyebolt;
- wherein the eyebolt structure attaches to the exterior lateral face of the base structure;
- wherein the eyebolt structure is located at a position that is superior to the cleat;
- wherein the eyebolt structure is located at a position proximal to the superior congruent end of the base structure;
- wherein the cord is threaded through the eyebolt structure such that the center axis of the cord is vertically redirected towards the cleat.

7. The canopy mounting and support system according to claim 6
- wherein the cleat is a mechanical structure;
- wherein the cleat attaches to the exterior lateral face of the base structure;
- wherein the cleat is located at a position that is inferior to the eyebolt structure;
- wherein the cleat is located at a position proximal to the inferior congruent end of the base structure;
- wherein the cord ties onto the cleat such that the cord runs through the eyebolt structure to attach to the tarpaulin.

8. The canopy mounting and support system according to claim 7 wherein the cord attaches the tarpaulin to an individual support structures;

wherein the cord is a flexible structure;

wherein the cord is formed with a tensile strength but does not have any significant compressive strength.

9. The canopy mounting and support system according to claim 8 wherein each cinch strap selected from the plurality of cinch straps is a fastening structure;

wherein each selected cinch strap binds the individual support structure to the vertically oriented anchor structure selected from the plurality of vertically oriented anchor structures that is associated with the individual support structure;

wherein each selected cinch strap binds the individual support structure to the selected vertically oriented anchor structure with a tight fit.

10. The canopy mounting and support system according to claim 9 wherein the plurality of cinch straps of each individual support structure comprises a superior cinch strap and an inferior cinch strap;

wherein the superior cinch strap is a first cinch strap selected from the plurality of cinch straps;

wherein the superior cinch strap binds the individual support structure to its associated selected vertically oriented anchor structure;

wherein the inferior cinch strap is a second cinch strap selected from the plurality of cinch straps;

wherein the inferior cinch strap binds the individual support structure to its associated selected vertically oriented anchor structure;

wherein the inferior cinch strap is located at a position that is inferior to the superior cinch strap.

11. The canopy mounting and support system according to claim 10 wherein the superior cinch strap further comprises a superior webbing, a superior quick release buckle, and a superior ring and slider arrangement;

wherein the superior webbing is a textile based webbing structure;

wherein the superior webbing is a flexible structure;

wherein the superior webbing forms the physical structure that binds the base structure of the individual support structure to the selected vertically oriented anchor structure;

wherein the superior quick release buckle is a fastening structure;

wherein the superior quick release buckle attaches the superior webbing to itself to form a loop structure that wraps around the selected vertically oriented anchor structure;

wherein the superior ring and slider arrangement is a mechanical structure;

wherein the superior webbing threads through the superior ring and slider arrangement;

wherein the superior ring and slider arrangement adjusts the span of the length of the superior webbing that is presented to the selected vertically oriented anchor structure by the superior cinch strap;

wherein the superior ring and slider arrangement adjusts the span of the length of the superior webbing such that the superior cinch strap binds to the selected vertically oriented anchor structure with a tight fit.

12. The canopy mounting and support system according to claim 11 wherein the inferior cinch strap further comprises an inferior webbing, an inferior quick release buckle, and an inferior ring and slider arrangement;

wherein the inferior webbing is a textile based webbing structure;

wherein the inferior webbing is a flexible structure;

wherein the inferior webbing forms the physical structure that binds the base structure of the individual support structure to the selected vertically oriented anchor structure;

wherein the inferior quick release buckle is a fastening structure;

wherein the inferior quick release buckle attaches the inferior webbing to itself to form a loop structure that wraps around the selected vertically oriented anchor structure;

wherein the inferior ring and slider arrangement is a mechanical structure;

wherein the inferior webbing threads through the inferior ring and slider arrangement;

wherein the inferior ring and slider arrangement adjusts the span of the length of the inferior webbing that is presented to the selected vertically oriented anchor structure by the inferior cinch strap;

wherein the inferior ring and slider arrangement adjusts the span of the length of the inferior webbing such that the inferior cinch strap binds to the selected vertically oriented anchor structure with a tight fit.

* * * * *